United States Patent [19]

Stilson

[11] Patent Number: 4,785,800

[45] Date of Patent: Nov. 22, 1988

[54] STRUCTURAL BALANCE DEVICE FOR RELIEVING STRESS

[76] Inventor: Robert L. Stilson, 9978 Wagner La., Westminster, Colo. 80030

[21] Appl. No.: 148,943

[22] Filed: Jan. 27, 1988

[51] Int. Cl.[4] ..... A61H 15/00

[52] U.S. Cl. ..... 128/57; 128/25 R; 128/68; 128/69; 128/78

[58] Field of Search ..... 128/25 R, 78, 69, 68, 128/24.3, 76, 57; 5/434, 435, 436, 440; 272/94

[56] References Cited

U.S. PATENT DOCUMENTS

| | | | |
|---|---|---|---|
| 2,777,440 | 1/1957 | Baker | 128/69 |
| 2,854,971 | 10/1958 | Williams | 128/69 |
| 3,258,790 | 7/1966 | Maru | 128/68 |
| 3,705,579 | 12/1972 | Morini et al. | 128/57 |
| 3,750,654 | 8/1973 | Shiu | 128/57 |
| 4,114,612 | 9/1978 | Benjamin | 128/69 |

*Primary Examiner*—Paul T. Sewell

*Assistant Examiner*—Kimberly L. Asher

*Attorney, Agent, or Firm*—Richard A. Kulp

[57] ABSTRACT

A structural balance device for relieving stress by reducing abnormal torque of the skull and rotation of the cervical spine while the user is lying in a supine position on a firm, flat surface. The device is dumbbell in shape with spherical ends and manufactured as a single embodiment of urethane rubber with a durometer rating of 55A to maintain stability under extended use. Use of the device will result in adjustment of the torque relationship of the skull to the ligaments, facia, muscles, nerves, and dural membrane of head and neck, extending into the dorsal and lumbar spines via musculature and the dural tube to relieve abnormal stress. The invention can be used similarly in the sacrum region, and in a prone position may be used at the junction of the symphysis pubis to reduce abnormal stress and promote relaxation in those areas.

1 Claim, 1 Drawing Sheet

STRUCTURAL BALANCE DEVICE FOR RELIEVING STRESS

BACKGROUND OF THE INVENTION

1. Technical Field

The invention relates to devices that alleviate rotatory instability of the cranio-cervical junction due to abnormal torque of the skull, which relieve stress in the head, neck, and spine.

The covering of the brain and spinal cord is called the dural membranes. These membranes attach to the foremen magnum, 1st and 2nd cervical vertebra, then extend down the spinal cord and terminate at the second sacral segment.

Undue stress on the spine and resultant discomfort is epidemic in the modern world. The abnormal torque of the head produces a rotation of the cranio-cervical junction and produces stress on all tissues, ligaments and muscles. The dural covering is also affected, resulting in a distress of the system which could affect the neurological system throughout the body.

Symptoms of head and neck tension produced by the above-described abnormal torque may be described as inability to sleep, headaches, pain in the cranio-cervical region, muscular tension throughout the upper parts of the body, memory instability and loss of concentration, stiffness in muscles and ligments, and possible psychosomatic disturbances. Stress reduction improves muscle balance and muscle force.

General effects of relaxation commonly engender reductions in hypertension, lowering of blood pressure, increased concentration and levels of physical activity, and psychological effects resulting from perceptions of mental wellbeing in the users.

Accordingly, it is the general object of the below-described invention to provide a means for alleviating abnormal torque in the cranio-cervical region of the user to reduce abnormal stress in the head, neck and spine.

In the supine position, the weight of the head of the user on the embodiment produces sufficient pressure to reduce by repeated use the abnormal torque of the skull. Use of the embodiment in this manner, particularly when accompanied by periods of up to 1 minute of use involving a mild motion of flexion and extension, produces a relaxing force that is transmitted through the entire length of the spine.

Also in the supine position the device can be placed at the junction of the sacrum and the right and left illium to reduce the abnormal stress of the pelvis and/or the sacrum. Used in this manner, the device will effect a relaxation of the above-described body parts.

The embodiment may also be utilized by placing it at the junction of the symphysis pubis while the user is in a prone position. The resultant pressure placed on that part of the body will induce a state of relaxation in the lower pelvic area.

The embodiment is shaped like a dumbbell in its general appearance with spherical ends in order to provide adequate support in the fulcrum area to reduce the torque of the skull. The deflection produced by the device is in direct proportion to the weight of the user's head. For this reason it is important to maintain the durometer at 55A (+/−2%), based on the standard industrial durometer rating using the "A" scale. Another feature of the spherical shape is to allow the user to maintain symmetry and comfort and assist in relaxing connective tissues appurtenant to the area of direct contact with the embodiment.

2. Background Art

U.S. Pat. No. 4,114,612 discloses a device for releasing muscular tension of the head-neck region of the user. The device comprises three elongated members each having a free edge, each edge projects at a 120° angle to the immediately adjacent edge. The cross-section of each edge is arcuate, with the first edge being of a first relatively small diameter, the second edge being of a second even smaller diameter and the third edge being of a third still smaller diameter. The device is arranged to be disposed upon a surface upon which the user lies, with two free edges disposed on said surface thereby forming a base and with the remaining edge projecting upward and exposed to suport the occipital area of the user as the user lies on said surface to thereby apply muscle tension-relieving pressure to said area.

U.S. Pat. No. 3,258,790 discloses a pillow which will allow air to circulate between the user's head and his bed when it is in use. Another object of this invention is to provide a pillow which will relieve tension and physical fatigue.

DISADVANTAGES TO PRIOR ART (1) Prior art addresses only release of muscle tension of the head and neck. The invention described herein offers a broader range of applications; (2) Prior art is cumbersome in design and intricate in manufacture. (3) Prior art offers some difficulty for the user due to the fact that there are complex decision regarding positions or choices of methods of use.

These devices have engendered some improvement over previous methods; however, no provision for the reduction of the torque effect of ligaments, fascia, muscles and the dural membrane of the cranial-cervical junction has been made.

SUMMARY OF THE INVENTION

As a means of responding to the aforesaid and related considerations, the herein-described invention provides an innovative and simple device to reduce torque of the skull and thus alleviate abnormal stress and its related symptoms of the head, neck and extending into the dorsal and lumbar spine. Due consideration was also given in the development of the embodiment that it be readily accessible to the widest possible number of potential users, which means the size of the device is very critical. It was designed to be produced both easily and inexpensively without undue delays in complex production methods or use of costly materials and manufacturing equipment.

The embodiment was designed to minimize its size, resulting in a small, light-weight, 8-ounce device that is readily transportable.

In its development, great consideration was given to the element of safety and durability; therefore care was taken in design to eliminate sharp angles, hard surfaces, or other potentially dangerous aspects.

The material, urethane rubber, for use in the manufacture of the embodiment was carefully chosen for its resistance to deterioration through changes in material composition, flexibility under extended usage, or changes in composition brought about by climatic conditions, chemical agents, or other adverse conditions.

INSTRUCTIONS FOR USE OF THE DEVICE

The user will lie on a comfortable, firm, flat surface. Flotation surfaces such as waterbeds are not suitable for use with this embodiment. Placing the device at the back of the head, just above the opening of the ears in the small depressions or saucers in the squama of the occipital bone on each side of the skull, the user will allow the weight of the head to rest on the device. The user will allow the weight of the head to rest on the device in a neutral position with the forehead and chin level, without any flexion or extension of his head. The invention may be adjusted by the user as need for comfort.

The user can begin by utilizing the device for a few minutes per session until he/she becomes familiar with the device and its effects; gradually extending the period of use to 10 to 15 minutes, or more if desired, several times per day. Once accustomed to the basic operation of the device, the user may begin a program involving a mild motion of flexion and extension of the head which may extend for intermittent periods of up to 1 minute throughout the session and comprising a gentle rolling motion for which the device was specifically designed in a spherical shape, to expedite the relaxation function of the above-described device resulting in reduction of abnormal stress.

The device can also be used to reduce undue stress in other areas of the body as mentioned previously.

DESCRIPTION OF THE PREFERRED EMBODIMENT

Figure 1:
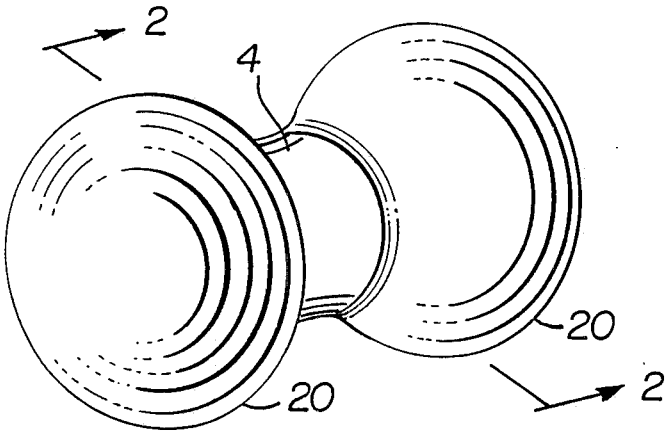
FIG. 1 is an oblique perspective view of the invention.
Figure 4:
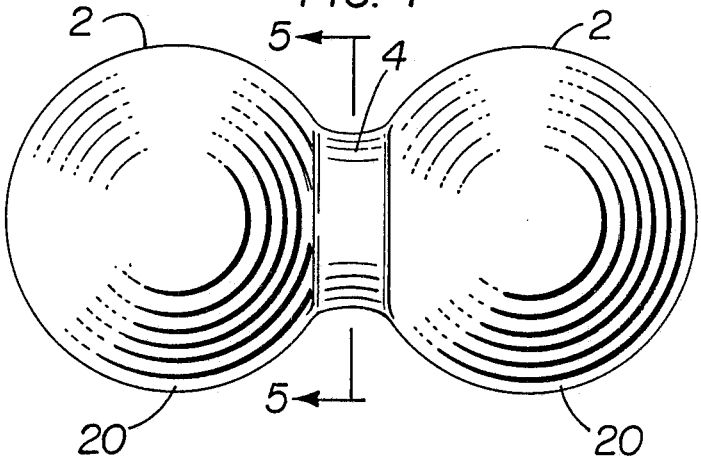
FIG. 4 is a side view of the FIG. 1 embodiment.

Referring now to the various figures of the drawing wherein like references character refer to like parts, there is shown in FIGS. 1 and 4 a structural balance device 20 in accordance with the instant invention and shown in a typical manner in which the device is used.

The functions, features, applications and benefits of the below-described embodiment will be readily apparent upon review of the following detailed description in conjunction with the accompanying drawings as briefly described.

Figure 2:
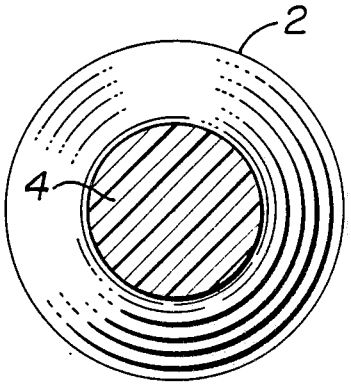
FIG. 2 is a cross-section of one end of the embodiment shown in FIG. 4 along Line 5—5.
Figure 3:
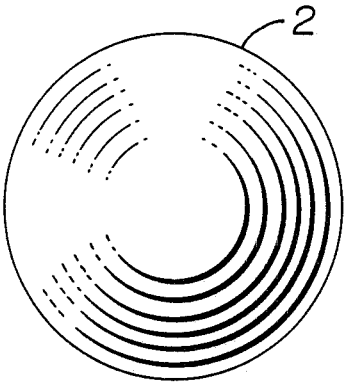
FIG. 3 is an end view of the FIG. 1 embodiment.

It must be first emphasized that it is absolutely essential that the invention be manufactured in a single solid embodiment (FIGS. 2 and 4) and in compliance with the specifications described in succeeding paragraphs.

The preferred choice of material is urethane rubber, however in actual manufacturing processes other types of rubber may be found suitable. The important parameter is that the durometer rating or hardness of the material must be maintained at 55A (+/−2 percent) because the deflection produced by the device is in direct proportion to the weight of the users head. With this specific durometer there is no friction during respiration of micro-motion between the users skull and the device but rather the motion is directed through the device itself, the device acting as part of the users head. Another reason for this specific durometer is to provide, insure and maintain proper stability of the device under conditions of extended use. Rubber of the proper consistency and composition enables the embodiment 20 (FIGS. 1 and 4) to be washed repeatedly in either hot or cold water without reducing, modifying or otherwise altering its designed properties. Furthermore, having no moving parts it is easy to maintain.

In its designed proportions, the embodiment 20 (FIG. 1) is moulded as a single solid device consisting of two spherical modules 2 of urethane rubber joined together by a short solid urethane rubber shaft 4 (FIGS. 1 and 4). The spherical modules 2 (FIGS. 1 and 4) are each $2\frac{1}{2}$ inches in diameter; the joining shaft 4 is $\frac{1}{2}$ inch in length and $3\frac{3}{4}''$ in circumference. The entire device measures $4\frac{3}{4}''$ in its longest dimension (FIG. 4). The above dimensions were obtained from careful measurement of many different skulls and should not vary more than +/−2%. These dimensions are required for the device to fit in the saucers of the squama of the occipital bone of most users skulls.

Figure 5:
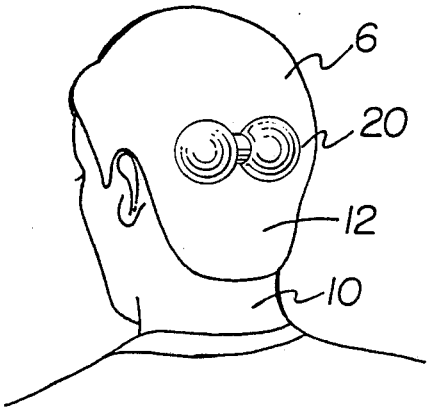
FIG. 5 is a perspective view of the device positioned on the upper posterior part of the user's skull, in small depressions in the squama of the occipital bone just above the opening of the ears.
Figure 6:
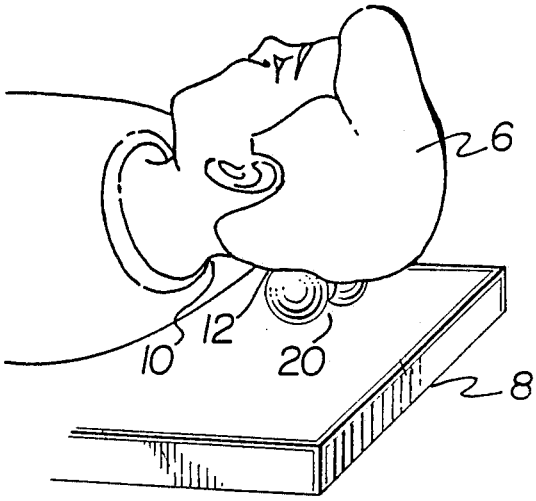
FIG. 6 is a perspective view of the device showing its operative relationship to a patient or user in the supine position on a flat surface according to the invention.

The connecting body 4 (FIGS. 1 and 4) has three functions: (a) Holds the two spheres 2 together at a designed distance; (b) Has absolutely no contact with the user's skull 6 (FIGS. 5 & 6), which plays an integral part in the function of the embodiment; (c) achieves the leveling effect by transferring pressure from one sphere to the other through this connecting shaft 4 as the head pressure of the user 6 (FIGS. 5 and 6) is equalized, causing a resultant reduction in torque of the cranio-cervical junction 12 (FIGS. 5 & 6) and produces relaxation. For example, when one side of the back of the skull is more posterior than the other, the passive pressure from the posterior side is exerted on the sphere on that side of the device and is then transferred through the connecting body to the other sphere on the other side (anterior side) to establish a leveling effect which in time reduces the torque of the skull and removes the tension at the cranio-cervical junction and releases stress. The same effect applies if one side of the back of the skull is more superior, inferior or lateral as compared to the other side.

The instant invention is designed and must be produced as a single solid embodiment 20 to maintain an even balance of surface tension when the torque position of the head is supported by the device. It cannot be hollow. While on a flat, hard surface 8 (FIG. 6), pressure of the head 6 (FIG. 6) will automatically be adjusted by the transference of pressure through one side of the device by means of its connecting body 4 (FIGS. 1 and 4) over to the other side to produce a leveling effect causing a reduction in the torque of the skull 6 (FIGS. 5 and 6) and the rotation of the cervical spine 10 (FIGS. 5 and 6) resulting in a relaxation of ligaments, fascia, muscles, nerves and dural membrane of the head which will also extend into the dorsal and lumbar spine.

Some of the advantages of the invention are that it is small, lightweight, easily transportable, offers great value to the user because of low cost, extremely comfortable to use, and does not require the user to read and understand complex instructions.

What is claimed is:

1. A structural balance device for relieving stress by reducing the torque of the skull and rotation of the cervical spine of the user, said device comprising of two solid spherical modules measuring $2\frac{1}{2}$ inches in diameter and connected by a short solid connecting shaft measuring $\frac{1}{2}$ inch in length and $3\frac{3}{4}$ inch in circumference, said device having an overall length of $4\frac{3}{4}$ inches, all said dimensions having a tolerance of +/−2%, wherein said device is molded as a single solid embodiment having an approximate weight of 8 ounces, 227 grams (+/−2%) and having the shape of a dumbbell, wherein said device comprises of urethane rubber having a durometer measurement of 55A (+/−2%) whereby: said device is placed at the back of the head, just above the opening of the ears in the small depressions or saucers in the squama of the occipital bone on each side of the skull and allowing the weight of the head to rest on the side device while in the supine position on a firm, flat surface, said device causing the deepening of the saucers in the squama which normalizes the torque of the skull, thus relieving the stress in the head, neck and spine.

* * * * *